US009322282B2

(12) United States Patent
Chouhan et al.

(10) Patent No.: US 9,322,282 B2
(45) Date of Patent: Apr. 26, 2016

(54) FILLET FOR USE WITH A TURBINE ROTOR BLADE TIP SHROUD

(71) Applicant: General Electric Company, Schenectady, NY (US)

(72) Inventors: Rohit Chouhan, Bangalore (IN); Harish Bommanakatte, Bangalore (IN); Sumeet Soni, Bangalore (IN); Srinivasa Govardhan Jayana, Bangalore (IN); Spencer Aaron Kareff, Simpsonville, NC (US)

(73) Assignee: General Electric Company, Schenectady, NY (US)

( * ) Notice: Subject to any disclaimer, the term of this patent is extended or adjusted under 35 U.S.C. 154(b) by 785 days.

(21) Appl. No.: 13/690,361

(22) Filed: Nov. 30, 2012

(65) Prior Publication Data

US 2014/0154079 A1 Jun. 5, 2014

(51) Int. Cl.
*F01D 5/22* (2006.01)
*F01D 5/14* (2006.01)

(52) U.S. Cl.
CPC ..... *F01D 5/225* (2013.01); *F01D 5/143* (2013.01); *F05D 2240/307* (2013.01)

(58) Field of Classification Search
CPC ... F01D 5/143; F01D 5/225; F05D 2240/307; F05D 2250/74
See application file for complete search history.

(56) References Cited

U.S. PATENT DOCUMENTS

| | | | |
|---|---|---|---|
| 6,857,853 | B1 | 2/2005 | Tomberg et al. |
| 6,893,216 | B2 | 5/2005 | Snook et al. |
| 7,063,509 | B2 | 6/2006 | Snook et al. |
| 8,057,186 | B2 | 11/2011 | Brittingham |
| 2008/0170946 | A1 | 7/2008 | Brittingham et al. |

FOREIGN PATENT DOCUMENTS

| | | | |
|---|---|---|---|
| EP | 1507064 | A2 | 2/2005 |
| EP | 1559869 | A2 | 8/2005 |

OTHER PUBLICATIONS

EP Search Report and Written Opinion dated Feb. 25, 2014 issued in connection with corresponding EP Application No. 13194959.6.

*Primary Examiner* — Ninh H Nguyen
*Assistant Examiner* — Jesse Prager
(74) *Attorney, Agent, or Firm* — Armstrong Teasdale LLP

(57) ABSTRACT

A turbine rotor blade is provided. The turbine rotor blade includes an airfoil, an airfoil tip, a tip shroud, and a fillet about an intersection of the airfoil tip and the tip shroud. The fillet defines a fillet profile variable about the intersection as a function of aerodynamic airflow about the intersection.

18 Claims, 6 Drawing Sheets

FILLET FOR USE WITH A TURBINE ROTOR BLADE TIP SHROUD

BACKGROUND OF THE INVENTION

The present invention relates generally to a fillet used with a turbine rotor blade, and more specifically, to a conical fillet used between a rotor blade and a tip shroud.

At least some known turbine rotor blades include an airfoil, a platform, a shank, a dovetail extending along a radial inner end portion of the shank, and a tip shroud formed at a tip of the airfoil. On at least some known airfoils, integral tip shrouds are included on a radially outer end of the airfoil to define a portion of a passage through which hot combustion gasses must flow. Known tip shrouds and airfoils typically include a fillet having a predetermined size and shape at the intersection of the tip shroud and airfoil.

During operation, tip shrouds are stressed because of centrifugal and mechanical forces induced to them during rotor rotation. The fillets are shaped to reduce the stress concentration between the airfoil and tip shroud, but known fillets may also reduce engine efficiency due to drag forces and obstruction produced by the fillets. While the stresses may be reduced by use of constant radius fillets, such a fillet design may be inefficient and adversely impact engine performance. Consequently, there has developed a need for a fillet having customized shape that has a more aerodynamic profile and that increases engine efficiency.

BRIEF DESCRIPTION OF THE INVENTION

In one aspect, a turbine rotor blade is provided. The turbine rotor blade comprises an airfoil, an airfoil tip, a tip shroud, and a fillet extending along an intersection of the airfoil tip and the tip shroud. The fillet defines a fillet profile variable about the intersection to facilitate improved aerodynamic airflow about the intersection.

In another aspect, a gas turbine engine including a turbine rotor blade is provided. The gas turbine engine includes a turbine rotor blade comprising an airfoil, an airfoil tip, a tip shroud, and a fillet extending along an intersection of the airfoil tip and the tip shroud. The fillet defines a fillet profile variable about the intersection to facilitate improved aerodynamic airflow about the intersection.

DETAILED DESCRIPTION OF THE INVENTION

A tip shroud, including a fillet, that generally is formed integrally with the turbine rotor blade at the radially outer end of an airfoil, provides a surface area that covers a tip of the airfoil. During operation, the tip shroud engages, at opposite ends, the tip shrouds of the immediately circumferentially-adjacent rotor blades such that a generally annular ring or shroud is formed that substantially circumscribes a hot gas path. This annular ring contains the expanding combustion to facilitate improving engine efficiency. The fillet joins the tip shroud to the airfoil and provides support to the tip shroud to prevent it from dislodging from the tip of the airfoil.

Generally, in terms of engine performance, it is desirable to have relatively large tip shrouds that each extend over substantially the entire radial outer end of the airfoil. Conversely, it is desirable that the fillet remain small and streamlined to guide the hot gas flow over the airfoil. Given these competing components, i.e., a large tip shroud to divert the greatest possible amount of air through the airfoils versus an aerodynamic rotor blade to increase engine efficiency, a more aerodynamic fillet is described herein that streamlines the flow of combustion gases while enabling for the tip shroud to adequately contain the hot gas flow.

Figure 1:
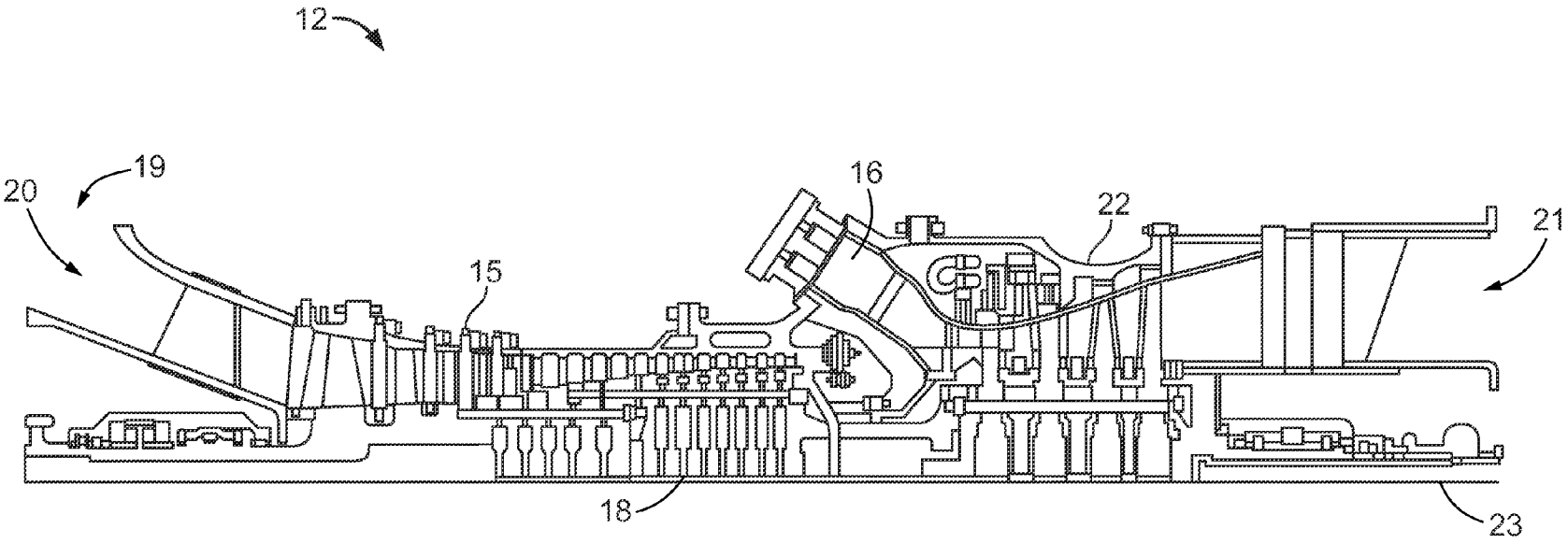
FIG. 1 illustrates a schematic view of an exemplary gas turbine engine.

FIG. 1 is a schematic illustration of an exemplary gas turbine engine 12 that includes a compressor 15, a combustor 16, and a turbine 22 extending therethrough from an intake side 19 to an exhaust side 21, all coupled in a serial flow arrangement. Engine 12 includes a centerline axis 23 and a hot gas path 20 is defined from intake side 19 to exhaust side 21.

In operation, air flows into intake side 19 and is routed to compressor 15. Compressed air is channeled from compressor 15 to combustor 16, wherein it is mixed with a fuel and ignited to generate combustion gases. The combustion gases are channeled via hot gas path 20 from combustor 16 towards turbine 22, where turbine converts the heat energy into mechanical energy to power compressor 15 and/or another load (not shown).

Figure 2:
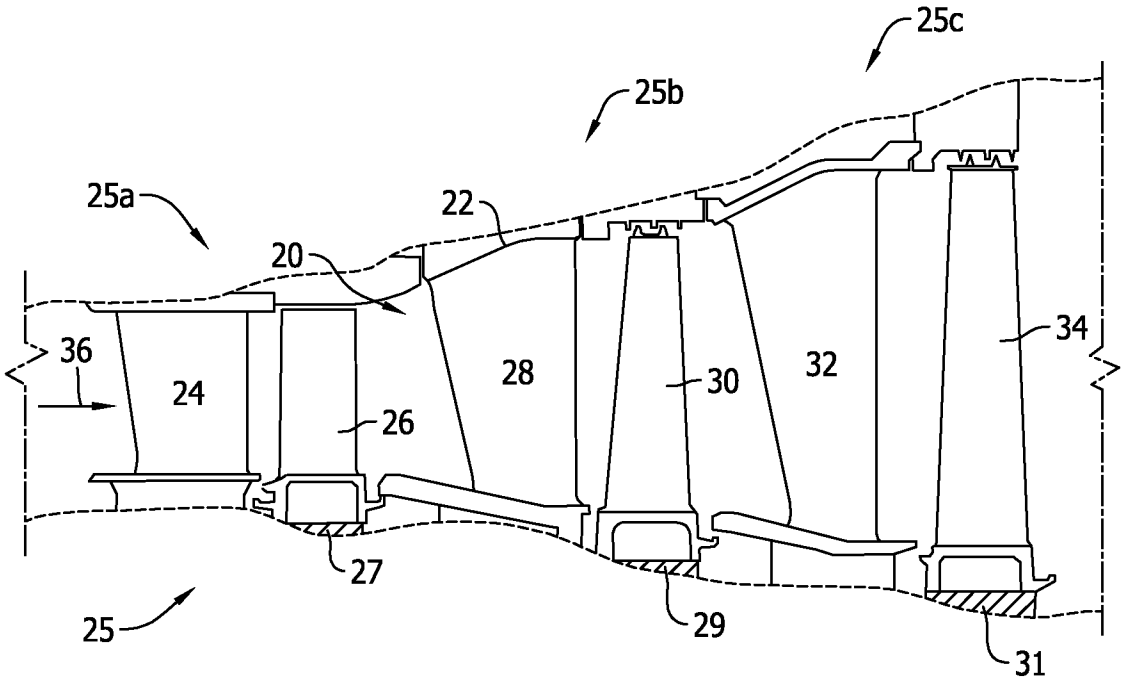
FIG. 2 illustrates a schematic representation of an exemplary hot gas path that may be defined in the gas turbine engine as shown in FIG. 1.

FIG. 2 is a schematic representation of an exemplary hot gas path 20 defined in multiple stages 25 of turbine 22 used in gas turbine engine 12. Three stages 25 are illustrated. A first stage 25*a* includes a plurality of circumferentially-spaced vanes or nozzles 24 and rotor blades 26. First stage vanes 24 are circumferentially-spaced one from the other about axis 23 (shown in FIG. 1). First stage rotor blades 26 are circumferentially-spaced about a first stage rotor disk 27 for rotation about axis 23. A second stage 25*b* of turbine 22 is also illustrated in FIG. 2. Second stage 25*b* includes a plurality of circumferentially-spaced vanes 28, and a plurality of circumferentially-spaced rotor blades 30 coupled to a second stage rotor disk 29. A third stage 25*c* also is illustrated in FIG. 2 and includes a plurality of circumferentially-spaced vanes 32 and rotor blades 34 coupled a third stage rotor disk 31. It should be appreciated that vanes 24, 28, and 32, and rotor blades 26, 30, and 34, are each positioned in hot gas path 20 of turbine 22. The direction of gas flow through hot gas path 20 is indicated by an arrow 36.

Figure 3:
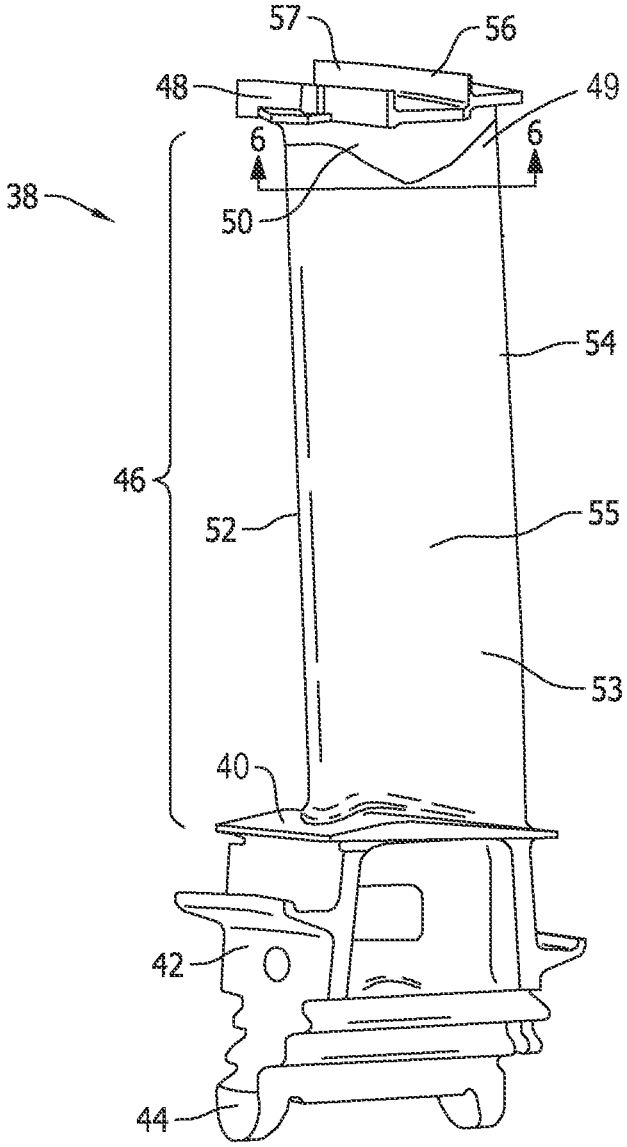
FIG. 3 illustrates a perspective view of an exemplary turbine rotor blade.

FIG. 3 illustrates a perspective view of an exemplary turbine rotor blade 38. Rotor blade 38 includes a platform 40, a shank 42, a dovetail 44, a tip shroud 48, and a fillet 50. Dovetail 44 couples blade 38 to a rotor disk 27, 29, or 31 (all shown in FIG. 2). Blade 38 also includes an airfoil 46 that extends radially between platform 40 and tip shroud 48. Airfoil 46 has a leading edge 52, a trailing edge 54, a pressure side 53, and an opposite suction side 55. Pressure side 53 extends from leading edge 52 to trailing edge 54 and forms a concave exterior surface of airfoil 46. Suction side 55 extends from leading edge 52 to trailing edge 54 and forms a convex exterior surface of airfoil 46.

In the exemplary embodiment, fillet 50 is defined and extends between airfoil 46 and tip shroud 48. More specifically, fillet 50 extends within the intersection formed between a tip 49 of airfoil 46 and tip shroud 48. Fillet 50 provides structural support to airfoil 46 and to tip shroud 48, and is shaped as described in more detail below, to facilitate streamlining a flow of hot gases past airfoil 46. In the exemplary embodiment, fillet 50 is sized and oriented relative to the intersection of tip shroud 48 and airfoil tip 49 to facilitate an aerodynamic flow of combustion gases through turbine 12 (shown in FIG. 2). The aerodynamic shape of fillet 50 facilitates reducing the specific fuel consumption of turbine 22 and facilitates increasing engine 12 efficiency. In an alternative embodiment, tip shroud 48 includes a seal rail 56 that extends circumferentially and that includes a cutter tooth 57 to facilitate sealing with a fixed casing (not shown). Tip shroud 48 also includes leading and trailing edges 52 and 54, respectively.

During operation, hot combustion gases flow over both pressure side 53 and suction side 55 of airfoil 46 to induce rotation of rotor blade 38. Specifically, the flow of the hot gases over both pressure side 53 and suction side 55 of airfoil 46 induces rotor blades 26, 30, and 34 to rotate about each respective rotor disk 27, 29, and 31 (shown in FIG. 2) such that the energy of the expanding hot gases is converted into the mechanical energy. In the exemplary embodiment, rotor blade 38, and fillet 50, may be a second stage rotor blade, such as blade 30, and/or a third stage rotor blade, such as blade 34.

Figure 4:
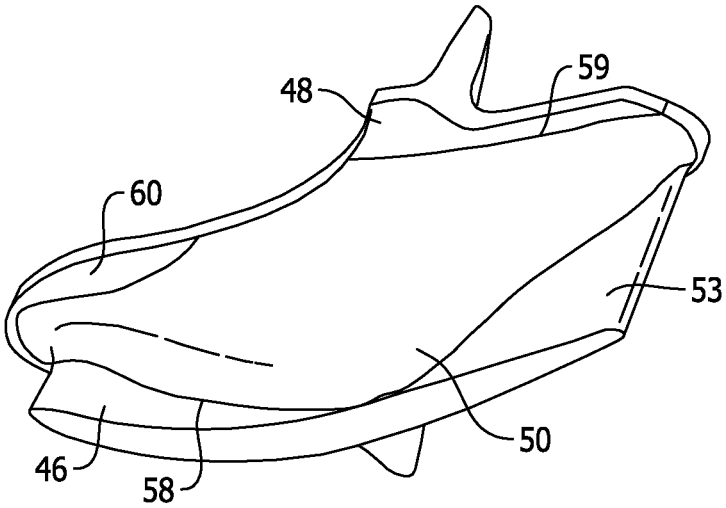
FIG. 4 illustrates an enlarged perspective view of an exemplary aerodynamic fillet that may be used with the rotor blade shown in FIG. 3.
Figure 5:
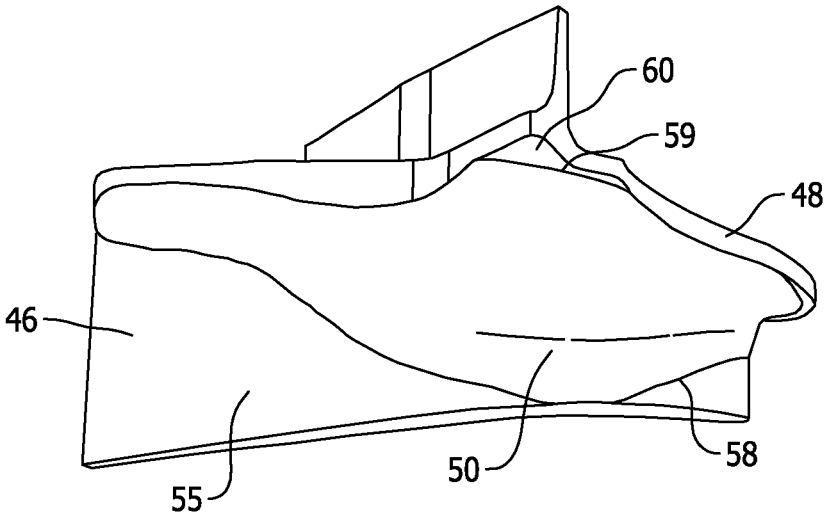
FIG. 5 illustrates an enlarged perspective view of the aerodynamic fillet shown in FIG. 4.

FIG. 4 illustrates an enlarged perspective view of an exemplary aerodynamic fillet 50 taken from a pressure side 53 of an airfoil 46. FIG. 5 illustrates an enlarged perspective view of fillet 50 taken from suction side 55 of airfoil 46. An edge of fillet 50 formed at its intersection with airfoil 46 on both pressure side 53 and suction side 55 is defined by an intersection line 58. An edge of fillet 50 formed at its intersection with tip shroud 48 is defined by an intersection line 59. Fillet 50 is sized to extend over substantially all of a radially inner surface 60 of tip shroud 48 along line 59. This fillet sizing is based on both mechanical stress requirements and aerodynamic efficiency requirements.

Figure 6:
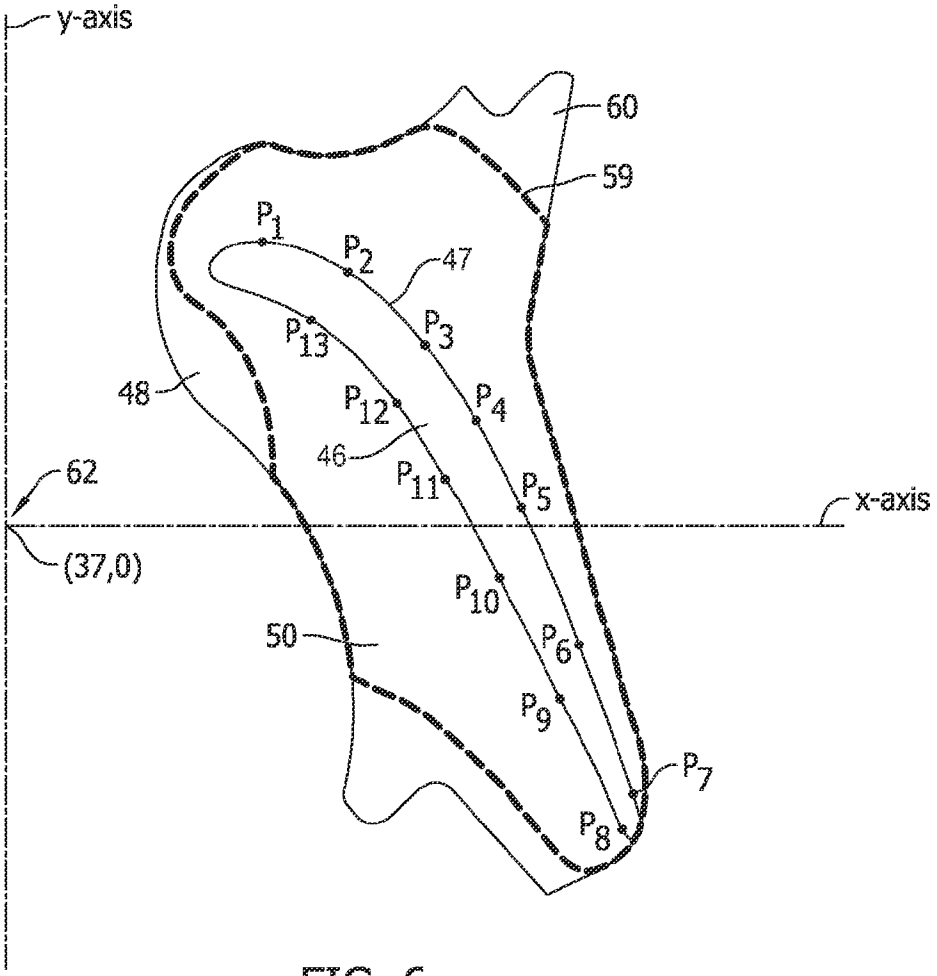
FIG. 6 is a radially outward cross sectional view of an airfoil profile section and fillet taken along line 6-6 and illustrating the locations of the X, Y, and Z coordinates set forth in Table I.
Figure 7:
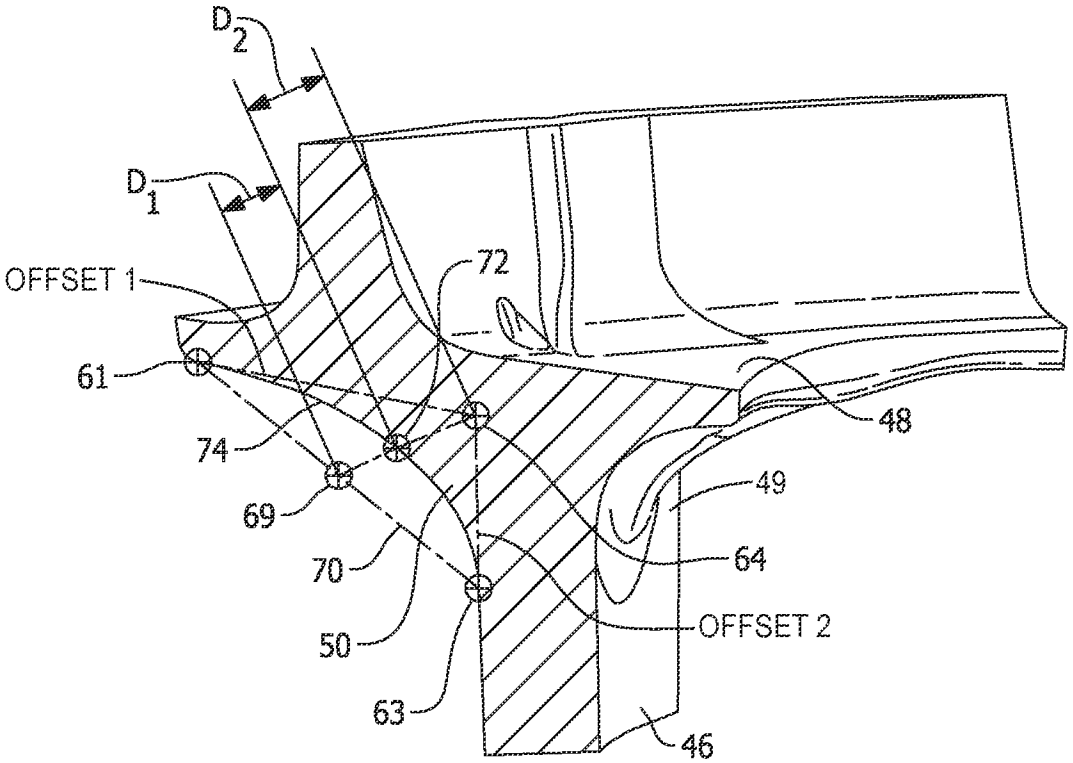
FIG. 7 is an exemplary cross sectional view through the airfoil, fillet, and tip shroud shown in FIG. 6.

FIG. 6 is a cross sectional view of a portion of airfoil 46 and fillet 50 taken along line 6-6 and illustrating exemplary locations of the X, Y, and Z coordinates set forth in Table I below. FIG. 7 is fragmentary cross sectional view through airfoil 46, tip shroud 48, and fillet 50. In the exemplary embodiment, fillet 50 is defined by thirteen points, P1-P13, in an X, Y coordinate system about the intersection of tip shroud 48 and airfoil tip 49 (shown in FIG. 3), which is shown as airfoil profile 47. Intersection line 59, shown as a dashed line in FIG. 6, illustrates the intersection of fillet 50 and tip shroud 48. At each X, Y location, the orientation of fillet 50 is determined by three parameters, offset 1 ($O_1$), offset 2 ($O_2$), and Rho. By defining variable conical fillet 50 using these parameters, the aerodynamic efficiency of fillet 50 is facilitated to be maximized, while the mass of blade 38 (shown in FIG. 3) is maintained at a minimum.

FIG. 6 illustrates an X, Y coordinate system with the X-axis extending horizontally, along centerline axis 23, (axially) at Y=0, the Y-axis extending transversely across engine 12 (radially) at X=0, and the Z-axis extending radially in the direction of airfoil 46 perpendicular to both the X-axis and Y-axis. The X, Y, and Z axes intersect at an origin 62. Origin 62 is located at coordinate (37, 0), such that X=0 is located at intake side 19 of engine 12 (shown in FIG. 1). Also illustrated in FIG. 6 are a plurality of locations about the intersection of airfoil profile 47 and radially inner surface 60 of the tip shroud 48 (without fillet 50) and designated by the letter P, followed by a number defining the location. The intersection of airfoil profile 47 and tip shroud 48 being designated apex location 64, wherein each point P1-P13 comprises an apex location 64. In Table I below, the locations P1-P13 are defined by the X, Y, and Z coordinates as set forth in the table.

The orientation and shape of fillet 50 is dependent at each X, Y, and Z location upon three parameters: offset 1 ($O_1$), offset 2 ($O_2$), and Rho. Offset 1 is designated $O_1$ and is a normal line having a linear distance measured in inches from airfoil 46 at each X, Y, and Z location designated P (apex location 64) along radially inner surface 60 of tip shroud 48 to an edge point 61 defined along intersection line 59. Offset 2 is designated $O_2$ and is a normal line having a linear distance measured in inches from tip shroud 48 at each X, Y, and Z location P (apex location 64) along surfaces 53 and 55 of airfoil 46 to an edge point 63 defined along intersection line 58. Intersection line 59, shown as edge point 61, defines the edge of $O_1$, and intersection line 58, shown as edge point 63, defines the edge of $O_2$. Lines 58 and 59 define the edges of offsets $O_2$ and $O_1$, respectively, such that fillet 50 is defined within the area contained between intersection lines 58 and 59. Edge points 61 and 63 are connected at respective tip shroud 48 and airfoil 46 such that edges 58 and 59 of fillet 50 are defined. Offsets $O_1$ and $O_2$ are determined by an iterative process at each P location about tip shroud 48 and airfoil tip 49 intersection, resulting in a more aerodynamic flow about fillet 50.

Rho is a non-dimensional shape parameter ratio at each location P. In the exemplary embodiment, Rho is defined as the ratio of:

$$\frac{D_1}{D_1 + D_2} \qquad \text{EQ. (1)}$$

wherein, as illustrated in FIG. 7, $D_1$ represents a distance defined between a midpoint 69 of a chord 70 extending between edge points 61 and 63 at a particular P location, apex 64, and a shoulder point 72 defined on a fillet surface 74 and $D_2$ is a distance defined between shoulder point 72 and the same P location (apex location 64). By connecting edge points 61 and 63, at each point P, with smooth continuing arcs extending through shoulder point 72, and in accordance with the shape parameter Rho, there is defined a fillet profile at each P location, apex 64, that provides a more aerodynamic flow of combustion gases through turbine 22 (shown in FIGS. 1 and 2). The surface shapes of the fillets, i.e., the fillet profile 74 at each location P, are joined smoothly to one another to form the nominal fillet profile 74 about the intersection of airfoil tip 49 and tip shroud 48. It will be appreciated that the shape of fillet surface 74 may vary dependent on the value of Rho. For example, a small value of Rho produces a very flat conic surface, while a large Rho value produces a very pointed conical surface. The Rho value thus determines the shape of the conical surface having a parabolic shape at Rho equals 0.5, an elliptical shape wherein Rho is greater than 0.0 and less than 0.5, and a hyperbolic shape where Rho is greater than 0.5 and less than 1.0.

The X, Y, and Z coordinate values, as well as the parameters $O_1$, $O_2$, $D_1$, $D_2$ and Rho are given in Table I as follows:

TABLE I

| Point | X | Y | Z | Offset 1 | Off-set 2 | D1 | D2 | Rho |
|---|---|---|---|---|---|---|---|---|
| 1 | 38.361 | 1.969 | 61.329 | 0.495 | 0.547 | 0.144 | 0.233 | 0.38 |
| 2 | 39.163 | 1.900 | 61.533 | 1.103 | 1.107 | 0.315 | 0.413 | 0.43 |
| 3 | 39.833 | 1.408 | 61.715 | 1.085 | 1.081 | 0.305 | 0.397 | 0.43 |
| 4 | 40.371 | 0.762 | 61.861 | 0.954 | 0.948 | 0.259 | 0.348 | 0.43 |
| 5 | 40.837 | 0.055 | 61.983 | 0.564 | 0.561 | 0.156 | 0.202 | 0.44 |
| 6 | 41.264 | −0.679 | 62.087 | 0.257 | 0.361 | 0.087 | 0.113 | 0.44 |
| 7 | 41.662 | −1.430 | 62.174 | 0.273 | 0.198 | 0.064 | 0.086 | 0.42 |
| 8 | 41.559 | −1.494 | 62.147 | 0.435 | 0.334 | 0.111 | 0.187 | 0.37 |
| 9 | 41.080 | −0.795 | 62.039 | 0.718 | 0.673 | 0.208 | 0.331 | 0.39 |
| 10 | 40.584 | −0.108 | 61.919 | 1.172 | 1.145 | 0.346 | 0.552 | 0.39 |
| 11 | 40.075 | 0.566 | 61.789 | 1.303 | 1.299 | 0.392 | 0.612 | 0.39 |
| 12 | 39.511 | 1.191 | 61.638 | 1.019 | 1.015 | 0.305 | 0.476 | 0.39 |
| 13 | 38.805 | 1.621 | 61.451 | 0.606 | 0.661 | 0.193 | 0.288 | 0.40 |

The Z value in Table I is a distance defined between the X-axis (engine centerline 23, shown in FIG. 1) and airfoil tip 49. It will also be appreciated that the values determining the surface configuration of fillet 50 given in Table I are for a nominal fillet. Thus, ±typical manufacturing tolerances, i.e., ±values, including any coating thicknesses, are additive to fillet surface 74 as determined from the Table I. Accordingly, a distance of ±0.05 inches in a direction normal to any surface location along fillet 50 defines a fillet profile envelope for this particular fillet 50, i.e., a range of variation between an ideal configuration of fillet 50 as given by the Table I above and a range of variations in fillet 50 configuration at nominal cold or room temperature. Fillet 50 is consistent within this range of variation such that the desired aerodynamic flow about fillet 50 is retained.

Moreover, Table I defines fillet 50 profile about the intersection of airfoil tip 49 and tip shroud 48. Any number of X, Y, and Z locations may be used to define this profile. Thus, the profiles defined by the values of Table I embrace fillet profiles intermediate the given X, Y, and Z locations as well as profiles defined using fewer X, Y, and Z locations when the profiles defined by Table I are connected by smooth curves extending between the given locations of Table I.

Also, it will be appreciated that fillet 50 may be scaled up or scaled down geometrically for use in other similar fillet designs in other turbines. For example, the offsets $O_1$ and $O_2$, as well as the X, Y, and Z coordinate values may be scaled by modifying the $O_1$, $O_2$, X, Y, and Z values according to a multiple to produce a scaled-up or scaled-down version of fillet 50. Because Rho is a non-dimensional value, modifying the $O_1$, $O_2$, X, Y, and Z values would not change the value of Rho.

It will also be appreciated that fillet 50 may be defined relative to airfoil 46 since the Cartesian coordinate system used to define fillet 50 and to define airfoil 46 identified above are common. Thus, fillet 50 may be defined relative to airfoil profile 47 shape at 7.5% span of airfoil 46 just radially inwardly of fillet 50. A Cartesian coordinate system of X, Y and Z values given in Table II below define the profile 47 of airfoil 46 at 7.5% span. The Z coordinate value at 97.560.45, the Z=0 value being at the X-axis, centerline 23 (shown in FIG. 1). In the exemplary embodiment, the intersection of airfoil tip 49 and tip shroud 48 lies 62.02 inches along the Z-axis from centerline 23 at 100% span. The values for the X, Y, and Z coordinates are set forth in inches in Table II although other units of dimensions may be used when the values are appropriately converted. The Cartesian coordinate system has orthogonally-related X, Y and Z axes and the X-axis lies parallel to engine centerline 23 such that a positive X coordinate value is axial toward the aft, i.e., exhaust side 21 of engine 12 (shown in FIG. 1). The Y-axis extends transversely across engine 12 perpendicular to the X-axis such that points P1-P5 and P11-P13 (shown in FIG. 6) have positive Y coordinate values. The Z-axis lies perpendicular to both the X-axis and the Y-axis and positive Z coordinate values are radially outward toward tip shroud 48.

In the exemplary embodiment, profile section 47 of airfoil 46 at 7.5% span is defined by connecting the X and Y values with smooth continuing arcs. By using a common origin 62 for the X, Y, and Z coordinate systems for fillet 50 points defined in Table I and airfoil profile 47 points defined in Table II at 7.5% span, fillet surface 74 configuration is defined in relation to airfoil profile 47 at 7.5% span. Other percentage spans could be used to define this relationship and the 7.5% span as used is exemplary only. These values represent fillet 50 and airfoil profile 47 at 7.5% spanat ambient, non-operating or non-hot conditions and are for an uncoated surface. Moreover, the dimensions of Table I may be scaled to account for engine size, manufacturing tolerances, coating thickness, or operational tolerances as described below.

As fillet 50, there are typical manufacturing tolerances as well as coatings which must be accounted for in airfoil profile 47. Accordingly, the values for profile 47 at 7.5% span given in Table II are for a nominal airfoil 46. It will therefore be appreciated that typical manufacturing tolerances, i.e., ±values, including any coating thicknesses, are additive to the X and Y values given in Table II below. Accordingly, a distance of ±0.05 inches in a direction normal to any surface location along airfoil profile 47 at 7.5% span defines an airfoil profile envelope, i.e., a range of variation between measured points on the actual airfoil surface at nominal cold or room temperature and the ideal position of those points as given in Table II below at the same temperature. Airfoil 46 within this range of variation retains the desired aerodynamic flow through rotor blades 38 (shown in FIG. 3).

TABLE II

| X | Y | Z |
|---|---|---|
| 38.23 | 1.8445 | 60.45 |
| 38.19659 | 1.805182 | 60.45 |
| 38.17603 | 1.757457 | 60.45 |
| 38.17609 | 1.705948 | 60.45 |
| 38.20436 | 1.662896 | 60.45 |
| 38.24925 | 1.636946 | 60.45 |
| 38.29877 | 1.621187 | 60.45 |
| 38.34942 | 1.609859 | 60.45 |
| 38.40056 | 1.600571 | 60.45 |
| 38.65644 | 1.555505 | 60.45 |
| 38.90644 | 1.486443 | 60.45 |
| 39.14336 | 1.384611 | 60.45 |
| 39.3643 | 1.252208 | 60.45 |
| 39.56881 | 1.095022 | 60.45 |
| 39.93091 | 0.732315 | 60.45 |
| 39.93091 | 0.732315 | 60.45 |
| 40.09591 | 0.534891 | 60.45 |
| 40.2543 | 0.331647 | 60.45 |
| 40.40832 | 0.125141 | 60.45 |
| 40.5604 | −0.0828 | 60.45 |
| 40.71241 | −0.29081 | 60.45 |
| 40.86547 | −0.49804 | 60.45 |
| 41.02038 | −0.70391 | 60.45 |
| 41.17584 | −0.90938 | 60.45 |
| 41.32945 | −1.1162 | 60.45 |
| 41.4786 | −1.32628 | 60.45 |
| 41.62369 | −1.53932 | 60.45 |
| 41.63605 | −1.55349 | 60.45 |
| 41.65205 | −1.56333 | 60.45 |
| 41.67043 | −1.56723 | 60.45 |
| 41.6891 | −1.56493 | 60.45 |
| 41.70629 | −1.55726 | 60.45 |
| 41.72068 | −1.54516 | 60.45 |

TABLE II-continued

| X | Y | Z |
|---|---|---|
| 41.73106 | −1.52953 | 60.45 |
| 41.73617 | −1.51149 | 60.45 |
| 41.73525 | −1.49272 | 60.45 |
| 41.72877 | −1.47499 | 60.45 |
| 41.60918 | −1.24831 | 60.45 |
| 41.48835 | −1.02229 | 60.45 |
| 41.36576 | −0.79724 | 60.45 |
| 41.24093 | −0.57343 | 60.45 |
| 41.11336 | −0.35118 | 60.45 |
| 40.983 | −0.13059 | 60.45 |
| 40.8495 | 0.087954 | 60.45 |
| 40.7119 | 0.303781 | 60.45 |
| 40.56925 | 0.516195 | 60.45 |
| 40.42057 | 0.724513 | 60.45 |
| 40.26443 | 0.927758 | 60.45 |
| 40.09879 | 1.123344 | 60.45 |
| 39.92184 | 1.308171 | 60.45 |
| 39.73177 | 1.479136 | 60.45 |
| 39.52675 | 1.633139 | 60.45 |
| 39.30655 | 1.765532 | 60.45 |
| 39.07231 | 1.869188 | 60.45 |
| 38.82475 | 1.936955 | 60.45 |
| 38.56799 | 1.956106 | 60.45 |
| 38.31727 | 1.900778 | 60.45 |
| 38.27135 | 1.876004 | 60.45 |

Thus, by defining airfoil profile 47 at 97.5% span and using the same Cartesian coordinate system as used to define fillet 50, the relationship between fillet 50 and airfoil 46 is established such that fillet 50 provides for an aerodynamic flow of air through the turbine.

A fillet defined between an airfoil and a tip shroud, such as fillet 50 above, not only provides support to the tip shroud to prevent it from dislodging from the tip of the airfoil, but also facilitates aerodynamic flow of hot combustion gases through the turbine of a gas turbine engine. As described above, in terms of engine performance, it is desirable to have relatively large tip shrouds that each extend over substantially the entire radial outer end of the airfoil. Conversely, it is desirable that the fillet remain small and streamlined to guide the hot gas flow over the airfoil. Given these competing components, i.e., a large tip shroud to divert the greatest possible amount of air through the airfoils versus an aerodynamic rotor blade to increase engine efficiency, the aerodynamic fillet described above streamlines the flow of combustion gases while enabling for the tip shroud to adequately contain the hot gas flow.

The fillet according to the present disclosure effectively balances these competing objectives such that engine performance goals may be satisfied. That is, the fillet shape of the present disclosure provides a profile that effectively guides hot gas flow through the turbine while facilitating containment of the hot gases by the tip shroud. In addition, the fillet shape according to the present application provides for other operational efficiencies, including, for example, stage airflow efficiency, enhanced aeromechanics, reduced thermal stresses, and reduced mechanical stresses when compared to other conventional fillet shapes. As one of ordinary skill in the art will appreciate, the effectiveness of the fillet shape according to the present invention may be verified by computational fluid dynamics (CFD); traditional fluid dynamics analysis; Euler and Navier-Stokes equations; flow testing (for example in wind tunnels), modification of the tip shroud; combinations thereof, and other design processes and practices. These methods of determination are merely exemplary, and are not intended to limit the invention in any manner.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A turbine rotor blade comprising:

an airfoil having an airfoil tip;

a tip shroud; and a fillet about an intersection of said airfoil tip and said tip shroud, said fillet defining a fillet profile variable about said intersection to facilitate improved aerodynamic airflow about said intersection, wherein said fillet defines a nominal profile substantially in accordance with coordinate values of X, Y, Z, offset 1, offset 2 and Rho set forth in Table I wherein X, Y, and Z define in inches discrete apex locations about the intersection of said airfoil tip and said tip shroud, offset 1 and offset 2 are respective distances in inches from each corresponding apex location to a fillet edge point defined between an undersurface of said tip shroud and an airfoil surface, wherein, upon connection about said respective tip shroud and said airfoil, said fillet edges are defined, and Rho is a non-dimensional shape parameter ratio of (D1/(D1+D2)) at each apex location, wherein D1 is a distance defined between a midpoint along a chord extending between said fillet edge points and a shoulder point defined on a surface of said fillet, and D2 is a distance defined between the shoulder point and said apex location, said fillet edge points on said tip shroud and said airfoil at each X, Y, and Z location being connected by a smooth continuing arc extending through said shoulder point in accordance with the shape parameter Rho to define a profile section at each said apex location, wherein said profile sections at each said apex location being joined smoothly with one another to form the nominal fillet profile.

2. A turbine rotor blade according to claim 1 wherein the fillet profile at a first point of intersection is one of a parabola, an ellipse and a hyperbola.

3. A turbine rotor blade according to claim 2 wherein the fillet profile at a second point of intersection is a curve different from said one parabola, an ellipse and hyperbola at said first point of intersection.

4. A turbine rotor blade according to claim 1, wherein each said apex location defines one of points P1-P13 as set forth in Table I.

5. A turbine rotor blade according to claim 1, wherein said blade is coupled within a second stage of a turbine.

6. A turbine rotor blade according to claim 1, wherein said blade is coupled within a third stage of a turbine.

7. A turbine rotor blade according to claim 1, wherein the X, Y, and Z distances and the offsets 1 and 2 are scalable as a function of the same constant to provide one of a scaled up and a scaled down fillet profile.

8. A turbine rotor blade according to claim 1, wherein said fillet profile lies in an envelope defined within ±0.050 inches in a direction normal to any fillet surface location.

9. A turbine rotor blade according to claim 1, wherein said X and Y values form a Cartesian coordinate system having a Z axis, said airfoil comprising an airfoil shape defining a nominal profile substantially in accordance with Cartesian coordinate values of X, Y and Z as set forth in Table II, wherein the Z value is at 97.5% span of the airfoil and wherein X and Y values in Table II are distances in inches which, when connected by smooth continuing arcs, define an airfoil profile section at 97.5% span, the X, Y and Z Cartesian coordinate systems for the fillet and airfoil profile being coincident.

10. A turbine rotor blade according to claim 9, wherein the X and Y distances and the offsets 1 and 2 are scalable as a function of the same constant to provide one of a scaled up and a scaled down fillet profile.

11. A turbine rotor blade according to claim 9, wherein said airfoil profile lies in an envelope within ±0.050 inches in a direction normal to any fillet surface location.

12. A gas turbine engine including a turbine rotor blade including an airfoil, an airfoil tip, a tip shroud, and a fillet about an intersection of said airfoil tip and said tip shroud, said fillet defining a fillet profile variable about said intersection as a function of aerodynamic airflow about said intersection, wherein said fillet defines a nominal profile substantially in accordance with coordinate values of X and Y, offset 1, offset 2 and Rho set forth in Table I wherein X and Y define in inches discrete apex locations about the intersection of the airfoil tip and tip shroud, offset 1 and offset 2 are distances in inches from each corresponding apex location to a fillet edge point along the tip shroud undersurface and airfoil surface, respectively, wherein, upon connection about the respective tip shroud and airfoil, the fillet edges are defined, and Rho is a non-dimensional shape parameter ratio of (D1/(D1+D2)) at each apex location, wherein D1 is a distance between a midpoint along a chord between said fillet edge points and a shoulder point on a surface of said fillet and D2 is a distance between the shoulder point and the apex location, said fillet edge points on said tip shroud and said airfoil at each X, Y location being connected by a smooth continuing arc passing through the shoulder point in accordance with the shape parameter Rho to define a profile section at each apex location, the profile sections at each apex location being joined smoothly with one another to form the nominal fillet profile.

13. A gas turbine engine according to claim 12, wherein each apex location defines one of points P1-P13 as set forth in Table I.

14. A gas turbine engine according to claim 12, wherein the X and Y distances and the offsets 1 and 2 are scalable as a function of the same constant or number to provide a scaled up or scaled down fillet profile.

15. A gas turbine engine according to claim 12, wherein said fillet profile lies in an envelope within ±0.050 inches in a direction normal to any fillet surface location.

16. A gas turbine engine according to claim 12, wherein said X and Y values form a Cartesian coordinate system having a Z axis, said airfoil having an airfoil shape, the airfoil defining a nominal profile substantially in accordance with Cartesian coordinate values of X, Y and Z as set forth in Table II wherein the Z value is at 97.5% span of the airfoil and wherein X and Y values in Table II are distances in inches which, when connected by smooth continuing arcs, define an airfoil profile section at 97.5% span, the X, Y and Z Cartesian coordinate systems for the fillet and airfoil profile being coincident.

17. A gas turbine engine according to claim 12, wherein the X and Y distances and the offsets 1 and 2 are scalable as a function of the same constant or number to provide a scaled up or scaled down fillet profile.

18. A gas turbine engine according to claim 12, wherein said airfoil profile lies in an envelope within ±0.050 inches in a direction normal to any fillet surface location.

* * * * *